United States Patent [19]

Lissant et al.

[11] Patent Number: 4,844,620

[45] Date of Patent: Jul. 4, 1989

[54] SYSTEM FOR PRODUCING HIGH-INTERNAL-PHASE-RATIO EMULSION PRODUCTS ON A CONTINUOUS BASIS

[75] Inventors: Kenneth J. Lissant, Clever; Charles H. Beltman, St. Louis; Guy M. Bradley, Chesterfield, all of Mo.

[73] Assignee: Petrolite Corporation, St. Louis, Mo.

[21] Appl. No.: 934,379

[22] Filed: Nov. 24, 1986

[51] Int. Cl.[4] ..... B01F 15/02

[52] U.S. Cl. ..... 366/136; 366/159; 366/161

[58] Field of Search ..... 366/136, 152, 159, 160, 366/161, 336; 137/896; 426/519, 602–605; 222/35, 318, 145

[56] References Cited

U.S. PATENT DOCUMENTS

| | | | |
|---|---|---|---|
| 2,254,049 | 8/1941 | Schutte | 426/605 X |
| 2,781,270 | 2/1957 | Crawford et al. | 426/605 X |
| 2,973,269 | 2/1961 | Melnick | 99/122 |
| 3,217,632 | 11/1965 | Elwood et al. | 99/244 |
| 3,360,377 | 12/1967 | Spitzer et al. | 99/123 |
| 3,457,086 | 7/1969 | Josefowitz et al. | 426/604 |
| 3,565,817 | 8/1968 | Lissant | 252/310 X |
| 3,661,364 | 5/1972 | Lage | 259/95 |
| 3,993,580 | 11/1976 | Galusky | 252/311 |
| 4,018,426 | 4/1977 | Mertz et al. | 259/7 |
| 4,117,550 | 9/1978 | Folland et al. | 366/136 |
| 4,212,544 | 7/1980 | Crosby | 137/896 X |
| 4,299,501 | 11/1981 | Patil et al. | 366/349 |
| 4,305,669 | 12/1981 | Hope et al. | 366/152 |
| 4,307,125 | 12/1981 | Amer | 426/604 |
| 4,443,487 | 4/1984 | Darling | 426/603 |

*Primary Examiner*—Stuart S. Levy
*Assistant Examiner*—Steven M. du Bois
*Attorney, Agent, or Firm*—Robert E. Wexler; Charles E. Smith

[57] ABSTRACT

System for preparing on a continuous basis high-internal-phase ratio emulsions wherein the external and internal phase materials making up such emulsions have highly disparate viscosities. The phase materials are introduced into a recirculation line and a portion of the prepared emulsion is continuously directly recycled through the system.

10 Claims, 2 Drawing Sheets

22
28
30
32
34
36
38
40
42
44
46
24
26

SYSTEM FOR PRODUCING HIGH-INTERNAL-PHASE-RATIO EMULSION PRODUCTS ON A CONTINUOUS BASIS

An emulsion is defined as a continuous liquid phase in which a second phase is dispersed. When one liquid phase is introduced with agitation into another liquid phase with which it is immiscible, the introduced liquid phase will disperse into discrete droplets. If the two liquid phases are pure, the droplets will begin to coalesce when agitation is stopped and two discrete layers will form. If, however, appropriate surface active materials, generally referred to as emulsifiers, are present in the system, coalescence will be prevented such that when agitation is stopped a layer of droplets of the dispersed phase will form. If the droplets of the dispersed phase, or internal phase, are small enough so that thermal and Brownian forces overcome the settling effect of the gravity field, then a stable emulsion results.

Emulsions comprising greater than about 75% by volume internal phase (dispersed phase) are referred to as high-internal-phase-ratio emulsions (HIPREs). The droplets present in HIPREs are deformed from the usual spherical shape into polyhedral shapes and are locked in place. Thus, HIPREs are sometimes referred to as "structured" systems and display unusual rheological properties which are generally attributed to the existence of the polyhedral droplets. For example, when HIPREs are subjected to sufficiently low levels of shear stress, they behave like elastic solids. As the level of shear stress is increased, a point is reached where the polyhedral droplets begin to slide past one another whereby the HIPRE begins to flow. This point is referred to as the yield value. When such emulsions are subjected to increasingly-higher shear stress, they exhibit non-Newtonian behavior, and the effective viscosity decreases rapidly.

When the shear rate ranges between 3000–8000 $sec^{-1}$, the effective viscosity of the emulsion decreases and at increasingly higher rates of shear, a point is reached where the emulsifying agents can no longer maintain stable films. At this point the emulsion breaks and cannot be reconstituted readily. The yield value and shear stability point, as well as the shape of the viscosity versus shear rate curve, will vary with each particular emulsion formulation.

Certain other emulsions behave in much the same manner as HIPREs. These emulsions can be referred to as variable-phase-ratio emulsions and contain an internal phase material, an external phase material and a modifying component which is a solid below a certain transition temperature and a liquid which is miscible with the external phase material above the transition temperature. When these emulsions are made at a temperature where the modifying component is a solid, the solid behaves as though it were part of the internal phase for geometric considerations. If the total volume ratio of the internal phase material and the solid are above about 75%, the emulsion then exhibits properties of a HIPRE. However, if the emulsion is heated to a temperature above the transition temperature of the modifying component or solid, the solid becomes a liquid and blends with the external phase material whereby the internal to external phase ratio falls below the HIPRE range of about 75% by volume. Where the external and internal phase materials have viscosities which are relatively similar, the emulsion will then be less viscous than a HIPRE consisting of the same two phase materials. However, where the viscosities of the two phases are highly disparate, the emulsion will continue to behave similarly to a HIPRE even though the emulsion has less than about 75% by volume of internal phase material. Such HIPRE-like emulsions typically contain from about 65% to about 75% (by volume) of internal phase material. Thus, where the emulsion includes a modifying component and internal and external phase materials having similar viscosities, such emulsions will behave as a medium-internal-phase ratio emulsion at temperatures above the transition temperature of the modifying component, and will behave similarly to HIPREs where the modifying component remains a solid. On the other hand, where the viscosities of the external and internal phase materials are highly disparate, the emulsion will behave similarly to a HIPRE regardless of whether the modifying component is in a liquid or a solid state. In both cases, the emulsions having modifying components which are in a solid state can technically be considered HIPREs.

The "structured" nature of HIPREs and HIPRE-like emulsions, in addition to providing an explanation for the unusual rheological properties displayed thereby, also provides an explanation for the fact that special mixing methods are required in order to prepare such emulsions.

If an attempt is made to mix two liquid phases of highly disparate viscosity, one finds that the mixing process is difficult and inefficient. When a small amount of low-viscosity liquid is added to a mass of high-viscosity liquid, it is difficult to incorporate homogeneously with conventional mixing means. Without appropriate mixing,a s more of the low-viscosity liquid is added, the highly viscous phase tends to break up and form a coarse dispersion in the thinner liquid. It is this fact which makes the preparation of HIPREs and HIPRE-like emulsions difficult and which has prevented development of successful continuous emulsification processes for materials of this type. With the correct type and degree of mixing, however, the low-viscosity liquid can be adequately dispersed within the high-viscosity liquid as it is added to form a stable emulsion.

One attempt at developing a continuous process for the production of HIPREs is disclosed in U.S. Pat. No. 3,565,817 and is directed at achieving sufficient mixing by providing shear rates high enough to reduce the effective viscosity of the emulsified mass near to the viscosities of the less viscous external and internal phases. Another attempt is disclosed in U.S. Pat. No. 4,018,426 which is also directed at achieving sufficient mixing by providing shear rates high enough to reduce the effective viscosity of the emulsified mass near to the viscosities of the less viscous external and internal phases.

However, for certain types of emulsions, it is not possible to apply enough shear thereto to effect an apparent viscosity near the viscosities of the external and internal phases without going above the shear stability point of the emulsion. Emulsions wherein the viscosities of the external and internal phases are highly disparate, such as, for example, certain low-fat spread emulsions, are examples of such emulsions.

Furthermore, although a variety of systems are capable of producing shear rates sufficient to reduce the effective viscosity of the emulsion phase to near the external and internal phase viscosities thereby allowing the phases to be mixed to a certain degree, such systems do not provide complete mixing of the phases as evidenced by the fact that there is always some non-emulsified liquid present in the prepared emulsion.

It has now been discovered that complete mixing can be effected without applying sufficient shear to reduce the effective viscosity of the emulsified mass to near the viscosities of the external and internal phases. Furthermore, it has now been discovered that by providing complete mixing, the presence of non-emulsified liquid in the prepared emulsion is significantly reduced or eliminated whereby improvements in the quality of emulsions, in terms of texture, is achieved. This is important in the cosmetics and food industries, as well as others, where produce appearance is a major marketing factor.

1. Field of the Invention

Accordingly, the present invention relates to a system for producing HIPREs and HIPRE-like emulsions on a continuous basis. More particularly, the present invention relates to a system for producing HIPREs and HIPRE-like products wherein the viscosities of the internal and external phases are highly disparate.

According to the present invention, complete mixing of the internal and external phases, particularly where the viscosities of the two phases are highly disparate, to prepare a HIPRE or a HIPRE-like emulsion is accomplished by providing a continuous process wherein the internal and external phases are introduced into a recirculation line and wherein continuous direct recycling of a portion of the prepared emulsion is achieved. The internal and external phases are fed into an inlet pipe by high-pressure metering pumps. The mixture of phases is propelled to a recirculation loop where a variable-speed pump forces it through a shearing device. A major portion of the resulting emulsion is drawn back into the pump for additional passes through the shearing device and the remaining portion is continuously propelled out of the loop. In this manner preformed emulsion having the desired ratio of internal to external phase materials is continuously circulated throughout the loop. The external phase material is dissolved in the external phase of the recirculated emulsion and the internal phase is dispersed thereinto in the form of small droplets when the combination of materials passes through the shearing device.

2. Prior Art

Lage U.S. Pat. No. 3,661,634 discloses a mixing system for easily mixed materials which includes means for recirculating product and means for introducing materials into the low pressure side of a circulating pump. Amer U.S. Pat. No. 4,307,125 discloses a process wherein products from mixing tanks are in part recycled to the tanks and some of the feed materials are introduced into the low pressure side of the recycling lines.

Melnick U.S. Pat. No. 2,973,269, Josefowicz et al U.S. Pat. No. 3,457,086, Elwood et al U.S. Pat. No. 3,217,632, Galusky U.S. Pat. No. 3,993,580, Spitzer et al U.S. Pat. No. 3,360,377 and Patil U.S. Pat. No. 4,229,501 disclose systems wherein a portion of a product is recirculated.

U.S. Pat. No. 3,565,817 discloses a process for the continuous preparation of high-internal-phase-ratio emulsions. U.S. Pat. No. 4,018,426 discloses a process wherein internal and external phase materials are introduced into a preformed emulsion while maintaining sufficient shear on the preformed emulsion to reduce the effective viscosity thereof to near that of the external phase material. U.S. Pat. No. 4,443,487 discloses a process for producing variable-phase-ratio emulsions.

SUMMARY OF THE INVENTION

This invention provides a novel system for preparing HIPREs and HIPRE-like emulsions wherein the internal and external phase materials have highly disparate viscosities. The subject system comprises introducing an internal and an external phase material into either the high or low pressure region of a recirculation loop. Such phase materials are then introduced into a mixing zone and caused to pass therethrough at a flow rate sufficient to cause a pressure drop of sufficient magnitude to thereby emulsify said phase materials. A portion of such emulsion is caused to pass out of the system while the remaining portion there of is recycled whereby continuous direct recycling of prepared emulsion is achieved.

DESCRIPTION OF A PREFERRED EMBODIMENT

Figure 1:
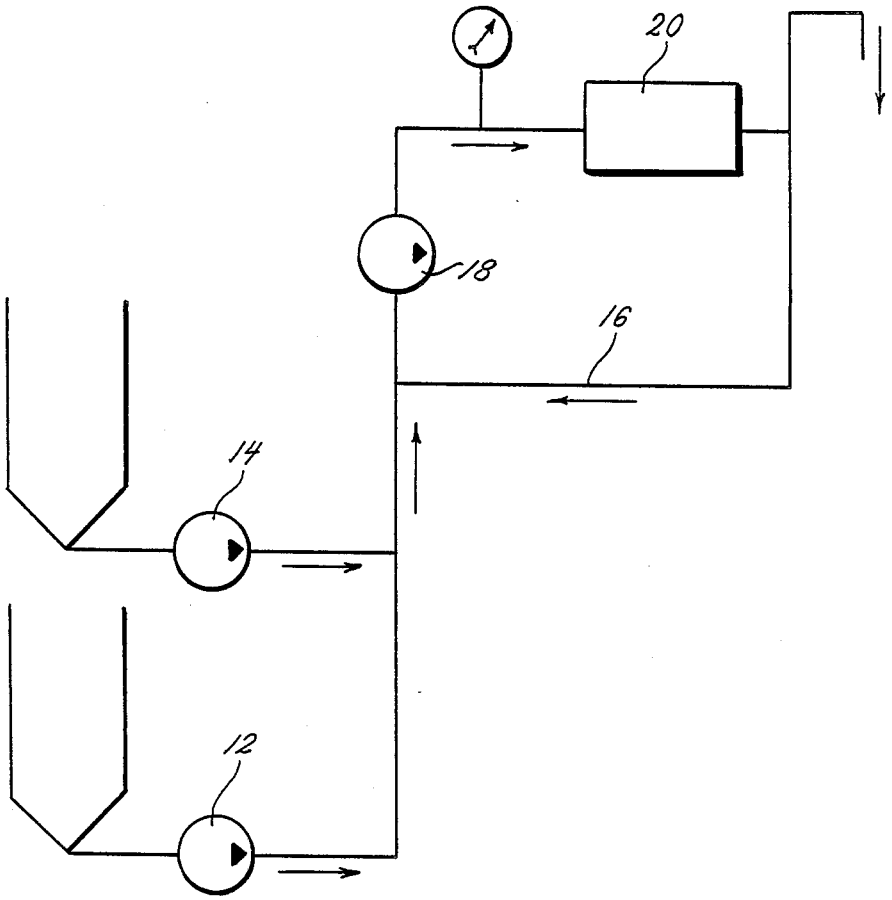
FIG. 1 is a schematic diagram of a system in accordance with the present invention.

Referring to the drawings wherein like numerals designate like parts, there is illustrated in FIG. 1 a flow diagram wherein an internal phase material is introduced into a flow line 10 by way of a first pumping means 12 which is preferably a positive displacement metering pump. Similarly, the external phase material is introduced into a the flow line 10, downstream from the point at which the internal phase material is introduced thereinto, by way of a second pumping means 14 which is also preferably a positive displacement metering pump.

Introduction of the external phase material can be downstream, upstream or at the same point in the flow line 10 where the internal phase material is introduced thereinto so long as continuous flow therethrough is achieved. The external phase material is shown in FIG. 1 for illustrative purposes only as being introduced into the flow line 10 downstream of the point where the internal phase material is introduced. Alternatively, the external and internal phase materials may be directly introduced into a recirculation loop 16 as hereinafter described.

The phase materials, as combined in the flow line, are propelled to the recirculation loop 16 where recirculating means 18, which is preferably a variable flow rate pump, forces such combination through a shearing device 20. Alternatively, the phase materials may be combined in the loop 16 and forced through the shearing device 20 by the recirculating means 18.

The recirculation loop 16 is adapted to provide for partial recirculation of processed phase materials as they exit the shearing device 20 whereby the recirculating means 18 draws a major portion of the processed materials through the loop 16 for additional passes through the system. The remaining portion of the processed phase materials is continuously propelled from the loop 16 as emulsion product.

Figure 2:
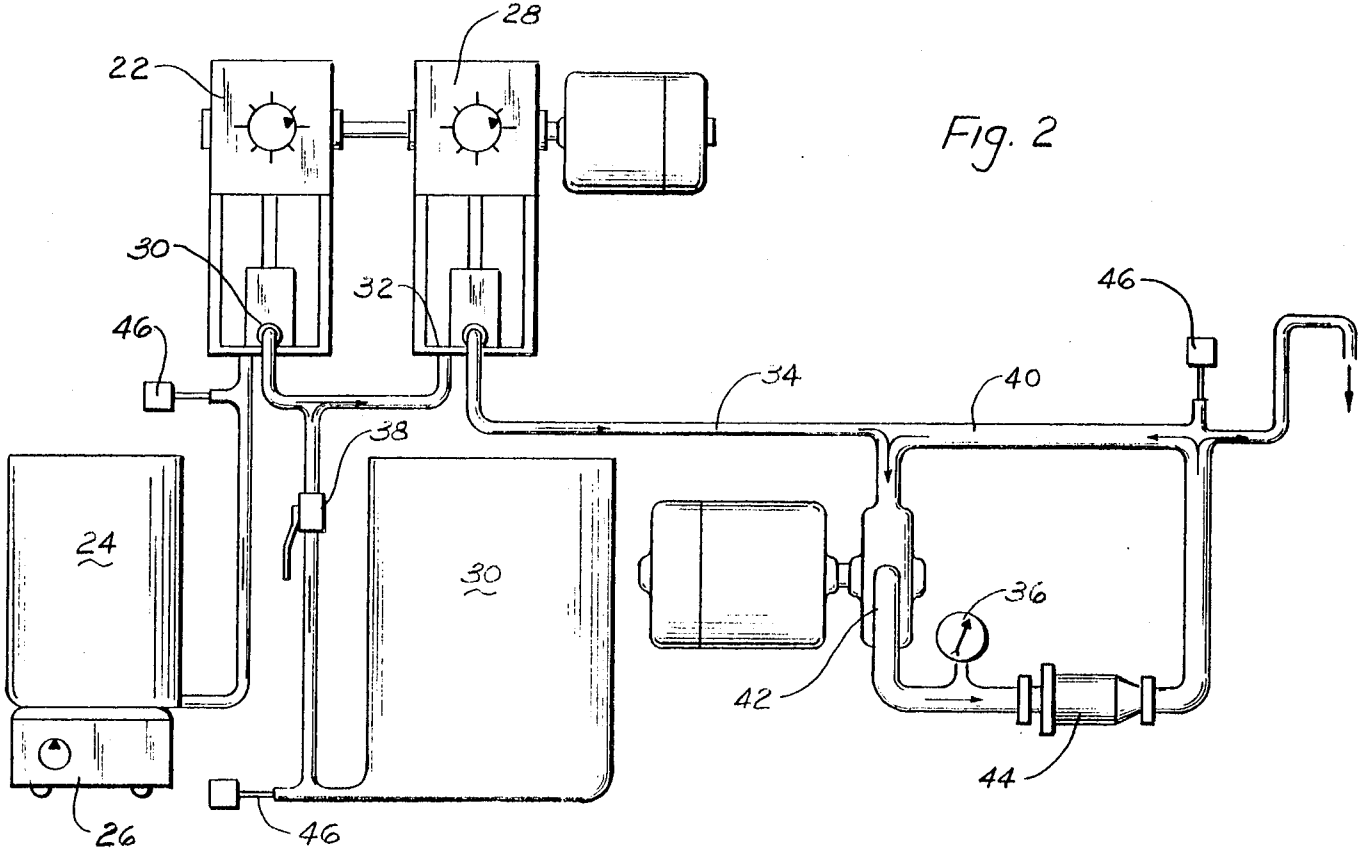
FIG. 2 is a schematic diagram of apparatus arranged in accordance with the present invention.

Referring to FIG. 2, there is shown preferred apparatus for use in the system of the present invention wherein an external phase pumping means 22 draws an external phase material from an external phase material tank 24. A heating device 26, such as, for example, a heating mantle, can be utilized to apply heat to the external phase material, or to the internal phase material, as required. Similarly, an internal phase pumping means 28 draws an internal phase material from an internal phase material tank 30.

Pumping means 22 and 28 may be the same or different. Suitable pumping means include positive displacement metering pumps which are adapted to provide variable flow rates. Such pumping means are typically reciprocating piston pumps with pulse dampeners. Suitable pumping means are commercially available from Bran & Lubbe, Inc.

For the application shown in FIG. 2, the unemulsified phases are pumped into the low pressure side of a recirculation loop 40. The outlet portion 30 of the pumping means 22 is routed to the inlet portion 32 of the pumping means 28, and the pumping means 28 is calibrated to deliver both phase materials to a flow line 34. Valve member 38 is closed during system start up and is open during normal operation. This arrangement may be modified by pumping the phases into a recirculation loop 40 separately, or by pumping the phases into the high pressure portion of the recirculation loop 40, provided that the pumping means 22 and 28 are capable of developing pressures exceeding the pressure existing in the recirculation loop 40.

The combined phase materials are then propelled into a recirculation loop 40 wherein a pumping means 42 serves as recirculating means and forces such combination into and through a shearing device 44 which is adapted to emulsify the combined phase materials without excessively heating the emulsion prepared thereby and without applying shear rates thereto which break the emulsion once it is formed. Pressure gauge 36 is used to calibrate the flow rate of the recirculating means 42.

A preferred shearing device is a static low to medium shear mixer of sanitary design. Such devices are available commercially such as, for example, the HYDROSHEAR devices available from Gaulin Corporation and the Ross Mixer Emulsifiers available from Charles Ross and Son Company.

The recirculation loop 40 is provided with a "T" to thereby provide means adapted to allow a portion of the emulsion which exits from the shearing device 44 to be drawn back into the pumping means 42 for additional passes through the recirculation loop 40. Since the loop 40 is completely filled with fluid at all times, the production rate will be equal to the flow rates of the internal and external phases.

The pumping means 42 is preferably a variable flow rate pump which is adapted to deliver variable flow rates and has at least 300 psi capability. Such pumps are typically non-centrifugal and are commercially available such as the VIKING® rotary pumps available from Houdaille Industries and the MOYNO™ progressive cavity pumps available from Robbins and Myers.

The pumping means 42 draws a major portion of the emulsion exiting from the shearing device 44 back into the recirculation loop 40 by way of the "T" and back into and through the pumping means 42 to thereby cause such emulsion to again pass through the shearing device 44. The remaining portion of such emulsion is continuously propelled from the system as emulsion product.

Temperature probes 46 are also provided to aid in monitoring the temperature of the phase materials and of the emulsion, if desired. Means for controlling the temperature of the phase materials and/or the emulsion product can include heating mantels and heating or cooling jackets. Other means are also available and are well known in the art.

The following examples are for illustrative purposes only and illustrate the best mode for preparing HIPREs and HIPRE-like products utilizing the system of the present invention.

EXAMPLES

| | % (by weight) |
|---|---|
| External Phase: | |
| Hydrogentated corn stick oil | 67.6 |
| Liquid corn oil | 29.2 |
| Santone 10-10-0 (decaglycerol decaoleate) | 1.7 |
| Emphos D-70-30-C (monosodium phosphate derivative of mono and diglycerides) | 0.8 |
| color and flavor | 0.7 |
| Internal Phase: | |
| Water | 97.9 |
| NaCl | 2.0 |
| Sodium Benzoate | 0.1 |
| Citric Acid to pH | 4.2 |

The start-up procedure utilized consisted of filling the recirculation loop 40 with external phase material while the recirculating pump 42 ran slowly. The recirculating pump 42 was then brought to full speed and the external phase material and the internal phase material were introduced into the flowline at the appropriate rates for producing a final emulsion having a composition of about 73% (by volume) internal phase material and about 27% (by volume) external phase material. A period of about three minutes was required to get within about 10% of the target phase ratio. The ratio of the recirculation flow rate to product flow rate was about 5.

The emulsion product produced is technically a HIPRE due to the solidification (crystallization) of the corn oil materials at room temperature. The emulsion being produced within the system at temperatures above room temperature is a HIPRE-like emulsion due to (1) the fact that the modifying component is dissolved in the external phase; and (2) the viscosity of the external oil phase is drastically different than the viscosity of the internal water phase. It is contemplated that other HIPREs and HIPRE-like emulsions can also be produced utilizing the system of the present invention. It should be recognized, however, that crystallization does not occur in all emulsion systems utilizing corn oil, but this occurrence is easily determined by one skilled in the art.

Best results are achieved when the combination of phase materials is forced through the shearing device 44 (along with recycled prepared emulsion) at a flow rate which results in a pressure drop of about 120 psi. It has been found for this particular emulsion system that flow rates which result in pressure drops of less than about 80 psi are not suitable for adequately mixing the phase materials. Furthermore, where the flow rates result in pressure drops of greater than about 130 psi, the shear stability point of this particular emulsion system was exceeded. Determining suitable parameters for other emulsion systems and other types of shearing devices is well within the skill of one in the art.

TABLE 1

| Example # | Ext. Phase Temp. (°C.) | Int. Phase Temp. (°C.) | Product Temp. (°C.) | Pressure Drop Across Hydroshear (psi) | Flowrate (ml/min) | Quality* |
|---|---|---|---|---|---|---|
| 1 | 26.6 | 21.0 | 27.0 | 60 | 218 | 2 D 4 |
| 2 | 26.5 | 21.0 | 27.8 | 80 | 218 | 2 D 4 |
| 3 | 26.5 | 21.0 | 26.3 | 100 | 218 | 2 D 4 |
| 4 | 26.5 | 21.0 | 25.8 | 120 | 218 | 2 D 4 |
| 5 | 29.3 | 21.0 | 26.6 | 60 | 340 | 2 B 2 |
| 6 | 28.9 | 21.0 | 25.8 | 80 | 340 | 2 B 2 |
| 7 | 27.2 | 21.0 | 26.0 | 100 | 340 | 2 A/B ½ |
| 8 | 30.4 | 21.0 | 24.7 | 60 | 420 | 3 B/C ⅔ |
| 9 | 30.2 | 21.0 | 25.3 | 80 | 420 | 3 B 2 |
| 10 | 28.5 | 21.0 | 25.2 | 100 | 420 | 2 B 2 |
| 11 | 29.6 | 21.0 | 25.9 | 120 | 420 | 2 A/B ½ |
| 12 | 30.2 | 21.0 | 24.5 | 80 | 593 | ¾ C 3 |
| 13 | 30.0 | 21.0 | 24.9 | 100 | 593 | 3 B ⅔ |
| 14 | 29.1 | 21.0 | 25.1 | 120 | 593 | 2 B 2 |
| 15 | 32.0 | 21.0 | inverted | 100 | 700 | inverted |
| 16 | 32.5 | 21.0 | 25.3 | 120 | 700 | 4 C ¾ |

*Quality Evaluation Firmness/Texture/Water Release

Product was judged subjectively on three criteria—firmness, texture, and water release—which are coded as follows:

| | Best | | Worst |
|---|---|---|---|
| Firmness | 1 (soft) | to | 4 (hard) |
| Texture | A (smooth) | to | D (coarse) |
| Water release | 1 (none) | to | 4 (max) |

These examples illustrate that different qualities of emulsion product may be obtained by varying phase temperatures, pressure drop (across the Hydroshear) and flow rate. These examples also illustrate that emulsions comprising very little or no non-emulsified liquid (water) can be obtained utilizing a system according to the teachings of the present invention. (For example, Examples 7, 8, 12 and 16).

It should be noted that the total combined flow rate of external phase material and internal phase material can be varied to achieve an emulsion of a desired composition. Also, the recirculation rate of prepared emulsion through the recirculation loop can be varied by way of the recirculating means and the amount of recirculated product can be varied by adjusting the flow rates of the internal and external phases.

Furthermore, it should be noted that this particular system heats the product 6°-9° C. and that air must be excluded from the recirculation loop. Processor plumbing must allow for the displacement of all air in the system upon initial filling to facilitate this. Phases should enter the recirculation loop at its lowest point, and the product should exit at the highest point.

It should also be noted that more than one shearing device may be utilized and that it is possible to utilize two or more shearing devices in parallel relationship or in series. The optimal total recirculation flow rate is a function of the number and arrangement of shearing devices in the plumbing loop. Each arrangement will require a different recirculation rate which rate can readily be determined by one skilled in the art. Also, it should be noted that introduction of the internal and external phase materials into the high pressure side of the recirculating means will accomplish similar results.

As pointed out above, best results are achieved for this emulsion system when the combination of phase materials and recycled emulsion is forced through the shearing device at a flow rate which results in a pressure drop of about 120 psi per Hydroshear. Where two shearing devices are utilized, best results are achieved when there is a total pressure drop of from about 200 to about 250 psi.

The following examples are for illustrative purposes only and demonstrate the best mode for utilizing two shearing devices (Hydroshears) in series to produce an emulsion of a desired quality.

TABLE 2

| Example # | Ext. Phase Temp. (°C.) | Int. Phase Temp. (°C.) | Product Temp. (°C.) | Pressure Drop Across Hydroshear (psi) | Flowrate (ml/min) | Quality |
|---|---|---|---|---|---|---|
| 17 | 43.0 | 14.8 | 21.7 | 150–240 | 865 | ⅔ B ⅔ |
| 18 | 47.5 | 13.9 | 21.7 | 100–150 | 865 | 3 B/C 3 |
| 19 | 48.7 | 14.0 | 24.0 | 200–275 | 865 | 3 B 3 |
| 20 | 49.8 | 14.4 | 22.8 | 150–225 | 1145 | 3 B 1 |
| 21 | 50.5 | 14.4 | 22.8 | 100–200 | 1145 | 3 B 2 |
| 22 | 37.0 | 31.0 | 26.0 | 200–250 | 1200 | 2 B/C 1 |
| 23 | 36.0 | 28.0 | 26.0 | 200–250 | 1200 | 2 B/C 1 |
| 24 | 36.0 | 23.4 | 24.5 | 175–225 | 1540 | 2 C 3 |
| 25 | 35.0 | 23.0 | 26.5 | 200–260 | 1540 | 2 B/C 2 |
| 26 | 35.0 | 27.5 | 27.5 | 200–260 | 1540 | ½ B 1 |
| 27 | 35.0 | 25.1 | 29.1 | 200–260 | 1540 | 2 B/C 1 |
| 28 | 43.0 | 25.2 | 26.4 | 200–250 | 1385 | ½ B 1 |
| 29 | 38.5 | 23.3 | 26.0 | 200–250 | 1385 | ½ B/C 1 |
| 30 | 34.7 | 23.4 | 25.4 | 200–250 | 1385 | 2 B/C 1 |
| 31 | 33.3 | 21.1 | 23.4 | 200–250 | 1385 | 2 B/C 1 |
| 32 | 34.0 | 20.6 | 23.5 | 200–250 | 1600 | 2 B 1 |

These examples further illustrate the capability of the system of the present invention to produce an emulsion which contains little or no non-emulsified liquid (water).

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

What is claimed is:

1. System for continuous production of an emulsion displaying the characteristics of a high-internal-phase-ratio emulsion, said emulsion having an internal phase composition in an amount of above about sixty-five percent (65%) by volume and an external phase composition with which said internal phase composition is immiscible, said system comprising:

a. means defining a first flow line adapted to receive said internal and external phase compositions;

b. pump means for continuously introducing said internal and external phase compositions into said first flow line at selected rates;

c. means defining a recirculation flow line absent holding means and adapted at one portion thereof to receive said phase compositions directly from said first flow line;

d. recirculating means positioned at a second portion of said recirculation flow line;

e. shearing means adapted to emulsify said phase compositions positioned at a third portion of said recirculation flow line;

f. means defining an outlet adapted to permit a portion of said emulsion to exit said recirculation flow line, the remaining portion of said emulsion proceeding through said recirculation flow line; and said shearing means located between said recirculating means and said outlet means;

g. means defining an inlet adapted to introduce the remaining portion of said emulsion back into said recirculation flow line for additional passes through said recirculation flow line, whereby said internal and external phase compositions are introduced into said first flow line and propelled into said recirculation flow line, to and through said shearing means and to said outlet wherein a portion of said emulsion exits said system and the remaining portion of said emulsion continues through said recirculation flow line, said remaining portion being drawn through said recirculation flow line by said recirculating means for additional passes through said recirculation flow line.

2. The system of claim 1 wherein said means is introducing the phase compositions includes selectively adjustable pumping means.

3. The system of claim 1 wherein said recirculating means includes a variable flow rate pump.

4. The system of claim 1 wherein said shearing means includes at least one static low-to medium shear mixer which effectively emulsifies said phase compositions.

5. The system of claim 1 wherein said internal phase composition comprises water.

6. The system of claim 5 wherein said external phase composition comprises oil and at least one emulsifier.

7. The system of claim 1 further including means for monitoring the temperature of said phase compositions.

8. The system of claim 1 further including means for controlling the temperature of said phase compositions.

9. The system of claim 1 further including means for monitoring the temperature of said emulsion.

10. The system of claim 1 further including means for controlling the temperature of said emulsion.

* * * * *